US007674088B2

(12) United States Patent
Khanin et al.

(10) Patent No.: US 7,674,088 B2
(45) Date of Patent: Mar. 9, 2010

(54) VANE ARRANGEMENT OF A TURBO MACHINE

(75) Inventors: Alexander Khanin, Moscow (RU); Iouri Strelkov, Moscow (RU); Sergey Vorontsov, Moscow (RU)

(73) Assignee: ALSTOM Technology Ltd., Baden (CH)

( * ) Notice: Subject to any disclaimer, the term of this patent is extended or adjusted under 35 U.S.C. 154(b) by 143 days.

(21) Appl. No.: 12/058,934

(22) Filed: Mar. 31, 2008

(65) Prior Publication Data

US 2008/0193289 A1 Aug. 14, 2008

Related U.S. Application Data

(63) Continuation of application No. PCT/EP2006/066140, filed on Sep. 7, 2006.

(30) Foreign Application Priority Data

Oct. 6, 2005 (CH) ..... 1614/05

(51) Int. Cl.
*F01D 9/00* (2006.01)

(52) U.S. Cl. ..... 415/209.3

(58) Field of Classification Search ..... 415/209.2, 415/209.3; 29/889.21, 889.2, 525.01
See application file for complete search history.

(56) References Cited

U.S. PATENT DOCUMENTS 2,982,519 A 5/1961 Haworth et al.

(Continued)

FOREIGN PATENT DOCUMENTS

DE 928746 6/1955

(Continued)

OTHER PUBLICATIONS

Search Report for Swiss Patent App. No. 01614/05(Jan. 12, 2006).

(Continued)

*Primary Examiner*—Edward Look
*Assistant Examiner*—Aaron R Eastman
(74) *Attorney, Agent, or Firm*—Cermak Kenealy Vaidya & Nakajima LLP; Adam J. Cermak

(57) ABSTRACT

A vane arrangement (1) of a turbo machine (4), in particular of a gas turbine, includes at least one vane carrier (2) attached to a housing (5) of a turbo machine (4), and several vanes (3) attached to the vane carrier (2) and circumferentially arranged side by side, wherein the attachment between the vane carrier (2) and respective vane (3) is adapted for being axially pluggable. In order to simplify dismounting of a single vane (3) at least one of the vanes (3) is provided with an extraction device (35) having at least one axially extending extraction through-hole (36). The respective extraction through hole (36) is provided with an inner thread (37), and the vane carrier (2) is provided with an abutment zone (38) axially opposing the extraction through hole (36). The extraction device (35) is adapted for inducing axially oriented extraction forces into the respective vane (3) by an extraction tool, which is provided with an outer thread and which is in order to extract the respective vane (3) from the vane carrier (2) inserted into the extraction through-hole (36) and axially pressing against the abutment zone (28).

12 Claims, 3 Drawing Sheets

U.S. PATENT DOCUMENTS 7,455,505 B2 * 11/2008 Hartmann et al. ..... 416/219 R

FOREIGN PATENT DOCUMENTS

| | | |
|---|---|---|
| DE | 1036581 | 8/1958 |
| DE | 1124969 | 3/1962 |
| DE | 4110270 | 10/1991 |
| EP | 0943785 | 9/1999 |
| EP | 1149662 | 10/2001 |
| EP | 1154804 | 6/2005 |
| WO | WO2007/039396 | 4/2007 |

OTHER PUBLICATIONS

International Search Report for PCT Patent App. No. PCT/EP2006/066140 (Dec. 5, 2006).

* cited by examiner

VANE ARRANGEMENT OF A TURBO MACHINE

This application is a Continuation of, and claims priority under 35 U.S.C. § 120 to, International application no. PCT/EP2006/066140, filed 7 Sep. 2006, and claims priority under 35 U.S.C. §§ 119, 365 therethrough to Swiss application No. 01614/05, filed 6 Oct. 2005, the entireties of which are incorporated by reference herein.

BACKGROUND

1. Field of Endeavor

The present invention relates to a vane arrangement of a turbo machine, in particular of a gas turbine.

2. Brief Description of the Related Art

A typical vane arrangement has at least one vane carrier attached to a housing of a turbo machine. Such a vane arrangement also includes several vanes attached to the vane carrier and arranged in circumferential direction side by side. Usually, each vane has a platform comprising at least two locking portions which are circumferentially displaced to each other. Each locking portion includes a tongue projecting in the circumferential direction from the platform and extending in axial direction. The vane carrier includes at least two carrier portions being circumferentially displaced to each other. Each carrier portion includes a groove which is open in the circumferential direction and extends in axial direction. The tongues of the locking portions and the grooves of the carrier portions are adapted to provide an axially pluggable and radially form locking attachment between the vane carrier and the respective vane.

A vane arrangement of this kind provides the possibility to mount and dismount single vanes without disassembling the whole vane carrier. Due to the high temperatures and forces, and due to impurity occurring during operation of the turbo machine, the pluggable attachment between the vane carrier and the vanes becomes rough-running or gets blocked. In order to remove the vanes, e.g., for maintenance purposes, high axial forces have to be induced into the respective vane. If disassembling of the whole vane carrier has to be avoided the necessary forces have to be applied to the vane airfoil. Pulling or pushing the vane at its airfoil increases the risk of damaging a thermal barrier coating of the airfoil or the risk of deforming the airfoil.

SUMMARY

One of numerous aspects of the present invention includes an improved vane arrangement simplifying the dismounting of single vanes.

Another aspect of the present invention is based on the general idea of providing at least one of the vanes with an extraction device adapted for inducing axially oriented extraction forces into the respective vane. By use of such an extraction device it is possible to apply axially oriented forces into the vane outside of the airfoil. Accordingly, deformation of the airfoil and damaging of the thermal barrier coating can be avoided.

To this end the extracting device advantageously includes at least one axially extending extraction through-hole which is provided with an inner thread. Additionally the vane carrier is provided with an abutment zone which opposes the extraction through-hole axially. In order to extract a vane from the vane carrier, an extraction tool provided with an outer thread is inserted into the extraction through-hole and screwed into the inner thread. By advancing it the extraction tool gets in contact with the abutment zone. Further advancement of the extraction tool into the extraction through-hole applies axial pressing forces into the vane carrier. Since the extraction tool is co-operating with the inner thread of the extraction through-hole, an axially oriented pulling force is induced into the vane as the reaction of the extraction tool pressing against the vane carrier. The extraction device enables the pulling-off of the vanes with very high extraction forces with the extraction tool. Preferably the extraction device is arranged and/or adapted for inducing the extraction forces in the area of the attachment between the vane carrier and the respective vane. Preferably the extraction device is arranged and/or adapted for inducing the extraction forces parallel and preferably coaxially to the plugging direction of the attachment.

According to a preferred embodiment, the extraction through-hole and the inner thread are provided at an extraction pin, which is a separate component with respect to the respective vane and with respect to the vane carrier. Since the vane and the extraction pin are different components, the material of the extraction pin can be chosen according to the requirement of inducing high pulling forces into the vane.

Other aspects and many of the attendant advantages of the present invention will be readily appreciated and become better understood by reference to the following detailed description when considered in connection with the accompanying drawings.

BRIEF DESCRIPTION OF THE DRAWINGS

Preferred embodiments of the invention are depicted in the drawings and will be explained in detail in the following description. Features that are substantially or functionally equal or similar will be referred to with the same reference sign(s).

DETAILED DESCRIPTION OF EXEMPLARY EMBODIMENTS

Figure 1:
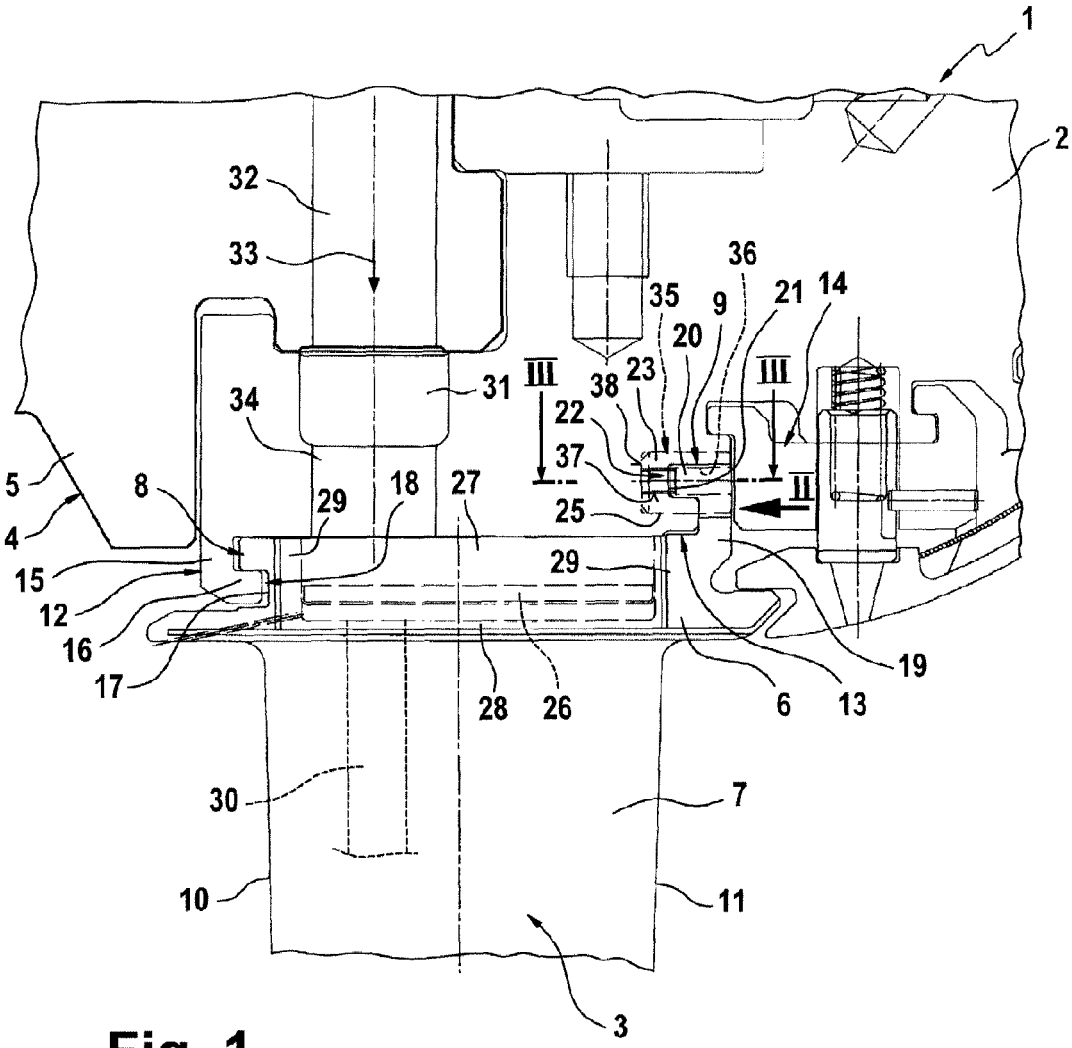
FIG. 1 depicts a simplified schematic axial section of a vane arrangement according to an embodiment of the invention.
Figure 2:
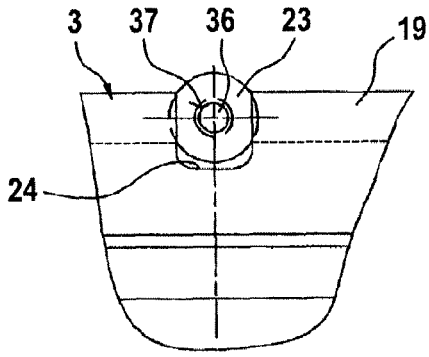
FIG. 2 depicts a view of a detail according to arrow II in FIG. 1.

According to FIG. 1 a vane arrangement 1 according to an embodiment of the invention includes at least one vane carrier 2 and several vanes 3. The vane arrangement 1 is part of a turbo machine 4. The turbo machine 4 in particular is a gas turbine. Basically the turbo machine 4 also could be a steam turbine or a compressor. The vane arrangement 1 includes the vanes 3 of a vane-row of the turbo machine 4. Usually the turbo machine 4 is provided with several vane-rows. As a matter of principal each of the vane-rows can show the vane arrangement 1 according to the invention.

The vane carrier 2 is attached to a housing 5 of the turbo machine 4. The vanes 3 are attached to the vane carrier 2. In order to build the vane-row, the vanes 3 are arranged circumferentially side by side.

In the depicted preferred embodiment, each vane 3 includes a platform 6 and an airfoil 7 radially and inwardly projecting from the platform 6. The platform 6 includes a first locking portion 8, depicted on the left side of FIG. 1, and a second locking portion 9, depicted on the right side of FIG. 1. The locking portions 8, 9 are arranged with an axial displacement between each other. For example, the first locking portion 8 is arranged in the area of a downstream side 10 of the airfoil 7, whereas the second locking portion 9 is arranged in the area of an upstream side 11 of the airfoil 7.

Complementary to the locking portions 8, 9 the vane carrier 2 includes a first carrier portion 12 and a second carrier portion 13. The two carrier portions 12, 13 also are axially displaced with respect to each other. Each locking portion 8, 9 and the respective carrier portion 12, 13 are adapted to provide an axial pluggable and radially form locking attachment between the vane carrier 2 and the respective vane 3. In other words, the co-operating locking portions 8, 9 and carrier portions 12, 13 establish an axial plug-in or push movement for mounting and an axial plug-off or pull movement for dismounting the respective vane 3. In the mounted condition the co-operating locking portions 8, 9 and carrier portions 12, 13 establish a radial fixation with form fit or positive fit between the vane carrier 2 and the respective vane 3.

Additionally, the vane arrangement 1 according to this embodiment includes at least one securing element 14, which is attached to the vane carrier 2. The securing element 14 is adapted for providing an axial fixation of at least one of the vanes 3. By means of the securing element 14 the vane 3 is axially fixed or secured in its mounted condition.

Preferably, the carrier portions 12, 13 and the locking portions 8, 9 extend in the circumferential direction. During mounting, basically each vane 3 is adjustable in the circumferential direction. Such an adjustment could be of advantage in order to eliminate or reduce clearance between adjacent vanes 3. According to the preferred embodiment the first locking portion 8 and the second locking portion 9 are arranged with radially displacement between each other. This feature leads to an axially compact structure of the vane arrangement 1 and also reduces manufacturing costs. As a matter of course the first carrier portion 12 and the second carrier portion 13 are also radially displaced relative to each other.

The first carrier portion 12 preferably includes an inner collar 15 projecting radially inwards from the vane carrier 2 and extending in the circumferential direction. The inner collar 15 is provided with an inner tongue 16 which extends axially and circumferentially. Complementary thereto the first locking portion 8 includes an inner groove 17. The inner groove 17 is axially open and extends circumferentially. The inner tongue 16 and the inner groove 17 are adapted to provide a first tongue and groove connection 18 between the vane carrier and the respective vane 3. In the mounted condition the inner tongue 16 projects axially into the inner groove 17 and radially engages the platform 6.

The second locking portion 9 includes an outer collar 19 projecting radially outwards form the platform 6 and extending in the circumferential direction. The outer collar 19 is provided with an outer tongue 20, which extends in the axial and circumferential directions. Accordingly, the second carrier portion 13 is provided with an outer groove 21 which is axially open and extends circumferentially. The outer tongue 20 and the outer groove 21 are adapted to provide a second tongue and groove connection 22 between the vane carrier 2 and the respective vane 3. In the mounted condition the outer tongue 20 projects axially into the outer groove 21 and radially engages the vane carrier 2.

As mentioned above, during mounting the vane 3 is basically adjustable in the circumferential direction. To circumferentially fix an adjusted position between the vane carrier 2 and the respective vane 3, a locking pin 23 is provided. The locking pin 23 penetrates a recess 24 which is formed in the outer collar 19. The locking pin 23 is inserted into a complementary pin reception 25 provided within the vane carrier 2. Accordingly, the locking pin 23 is a separate component with respect to the vane 3 and to the vane carrier 2.

According to FIG. 1 the platform 6 preferably includes a hollow space 27 which is open to the vane carrier 2. The hollow space 27 is radially inwardly limited by a base 28 of the platform 6. The airfoil 7 projects radially inwardly from the base 28. The hollow space 27 is axially and circumferentially limited by walls 29. The walls 29 project radially outwardly from the base 28. The hollow space 27 establishes a cooling gas distributing chamber. For example, the airfoil 7 contains a cooling gas path 30 which is fluidly connected to the hollow space 27 through the base 28.

The vane carrier 2 is provided with a common collector channel 31. The common collector channel 31 extends circumferentially and extends preferably along the whole vane carrier 2. The housing 5 is provided with at least one cooling gas supply channel 32 fluidly connected to a cooling gas supply device (not shown). The cooling gas supply channel 32 is also fluidly connected to the common collector channel 31 and therefore supplies the common connector channel 31 with cooling gas. The cooling gas flow is symbolized by an arrow 33. The vane carrier 2 is additionally provided with several connection holes 34. Each connection hole 34 fluidly connects the common collector channel 31 with one of the hollow spaces 27. Accordingly the hollow spaces 27 of the vanes 3 are supplied with cooling gas from the common collector channel 31 via the respective connecting hole 34. Within the hollow space 27, a deflector 26 can be arranged.

The use of a common collector channel 31 for supplying several or all vanes 3 with cooling gas, which is preferably air or steam, has the advantage, that the cooling gas supply of the respective vanes 3 can be established with the same pressure because of nearly identical cooling gas path configurations between the common collector channel 31 and the hollow spaces 27 of the respective vanes 3. Additionally, the at least one cooling gas supply channel 32 can be arranged within the housing 5 independently from the position of the respective vanes 3. Also, the number of cooling gas supply channels 32 can be less than the number of vanes 3 to be supplied with cooling gas. The flexibility of designing the housing 5 is increased and, thus, the manufacturing costs of the housing 5 are reduced.

One of the walls 29, which axially limits the hollow space 27 in the area of the downstream side 10 of the airfoil 7, is provided with the first locking portion 8. The other wall 29, which axially limits the hollow space 27 in the area of the upstream side 11 of the airfoil 7, is provided with the second locking portion 9. Accordingly, the hollow space 27 axially extends from the downstream side 10 to the upstream side 11. In the circumferential direction the hollow space 27 extends over the whole circumferential extension of the base 28.

At least the depicted vane 3 of the vane arrangement 1 is provided with an extraction device 35. Preferably each vane 3 of the vane arrangement 1 is provided with such an extraction device 35. With help of the extraction device 35, dismounting or extraction of the vane 3 from the vane carrier 2 is simplified. The extraction device 35 enables the technician to apply very high axial pulling or extraction forces to the vane 3 without the risk of deforming the airfoil 7 or damaging a thermal barrier coating of the airfoil 7.

In the preferred exemplary embodiment depicted in the figures, the extraction device 35 includes the locking pin 23, the recess 24, and the pin reception 25. Accordingly, the locking pin 23 in the following is also called an extraction pin 23. The extraction device 35 includes at least one extraction through-hole 36. This extraction through-hole 36 extends in the axial direction and therefore extends parallel to the mounting or plugging direction of the vane 3. The through-hole 36 is provided with an inner thread 37 covering the through hole 36 or only a portion of the through hole 36, as in the example.

The extraction device 35 also includes, for each extraction through-hole 36, an abutment zone 38 which axially opposes the extraction through-hole 36 and which is provided at the vane carrier 2.

In the preferred embodiment according to the depicted example, the extraction through hole 36 is provided within the extraction pin 23, and the abutment zone 38 is provided at an axial end or basement of the pin reception 25.

Figure 3:
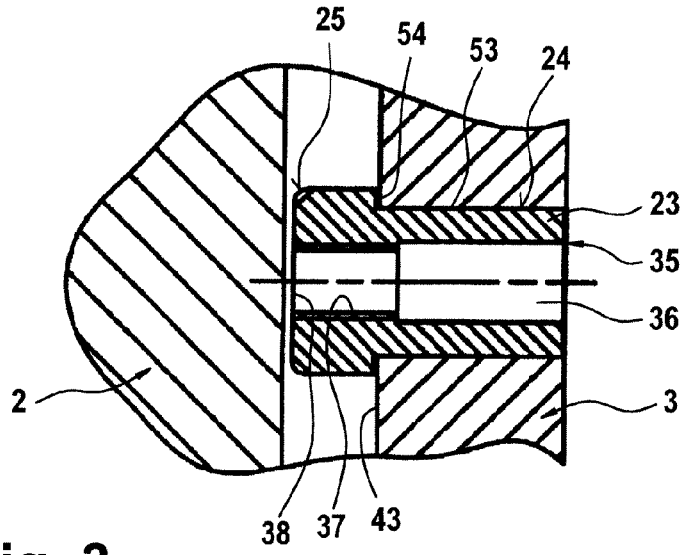
FIG. 3 depicts a section of a detail of the vane arrangement according section lines III in FIG. 1.
Figure 4:
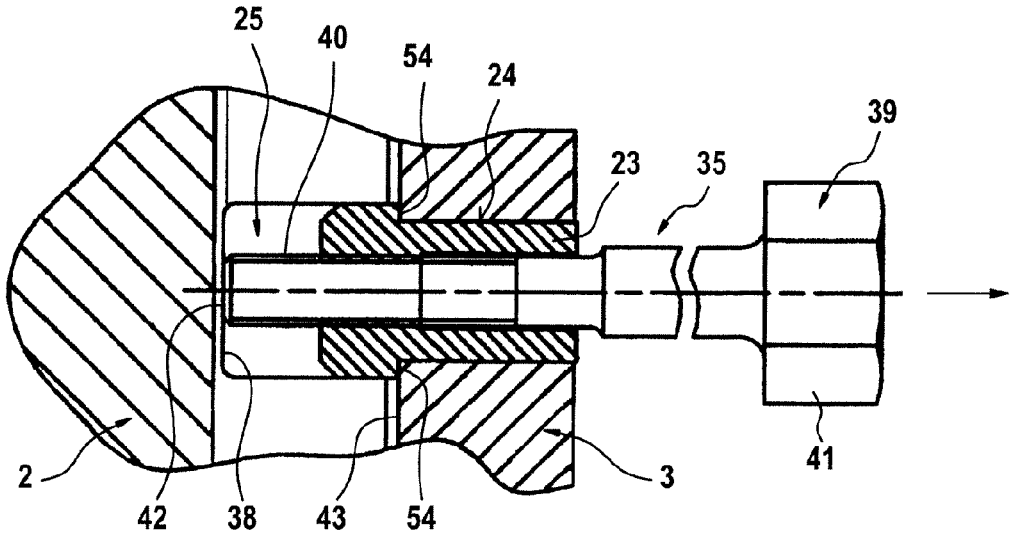
FIG. 4 depicts the section of FIG. 3 during dismounting of a vane.

According to FIGS. 3 and 4, the extraction device 35 is adapted for co-operating with an extraction tool 39 in order to dismount the vane 3 from the vane carrier 2. The extraction tool 39 is provided with an outer thread 40 which is complementary to the inner thread 37 of the extraction through-hole 36. Accordingly, the extraction tool 39 fits in the through-hole 36. The extraction tool 39 is also provided with a drive portion 41 adapted for applying torque into the extraction tool 39. For example, the extraction tool 39 is a special screw having a head with an hexagonal bolt.

If the vane 3 has to be dismounted, the extraction tool 39 is inserted or screwed into the extraction through-hole 36 until a leading end 42 of the extraction tool 39 comes into contact with the abutment zone 38. Further inserting or screwing of the extraction tool 39 into the extraction through-hole 36 leads to axial pressure between the extraction tool 39 and the abutment zone 38. The extraction tool 39 is, via its outer thread 40 and via the inner thread 37, supported by the body containing the through-hole 36. In the example, the extraction tool 39 is supported by the extraction pin 23 which abuts on the vane 3, namely on a support contour 43 of the vane 3 facing the abutment zone 38. Accordingly, the extraction tool 39 is supported indirectly at the vane 3, namely via the extraction pin 23.

The action of applying high axial forces into the vane carrier 2 by the extraction tool 39 leads to the reaction of correspondingly high extraction or pulling forces induced into the vane 3. Usually the pulling forces applied with help of the extracting device 35 by the extraction tool 39 are high enough to dismount the vane 3. Since the extraction device 35 is arranged outside of the airfoil 7, namely in the area of the attachment between the vane 3 and the vane carrier 2, the extraction forces cannot have a detrimental effect on the airfoil 7 or on a thermal barrier coating of the airfoil 7.

Figure 5A:
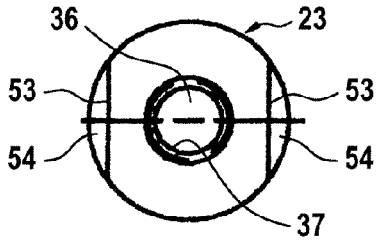
FIGS. 5*a-c* depict different views and a section of an extraction pin.
Figure 5B:
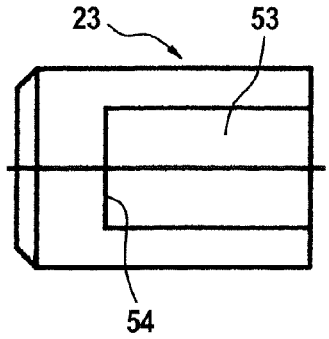
Figure 5C:
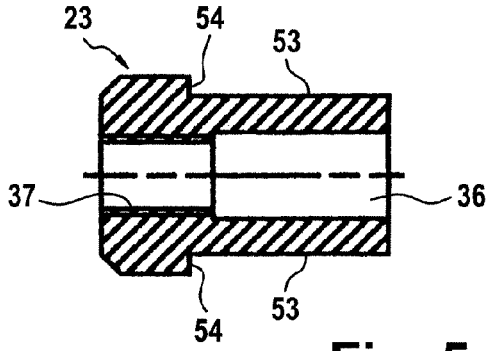

In order to avoid a rotary motion of the extraction pin 23 during rotation of the extraction tool 39 into the through-hole 36, the extraction pin 23 is torque-proof-fixed to the vane 3. To this end the extraction pin 23 is, according to FIGS. 5*a* to 5*c*, provided with two outer surfaces 53 which are arranged at two diametrically opposed sides of the extraction pin 23. The two outer surfaces 53 are plane and extend parallel to each other. Inserted into the recess 24 the two outer surfaces 53 rest against opposing walls of the recess 24.

In order to transmit high extraction forces from the extraction tool 39 on to the vane 3, the extraction pin 23 is provided with at least one step 54 resting at the support contour 43 of the vane 3. In the depicted example the extraction pin 23 is provided with two steps 54.

In the preferred embodiment depicted in the figures the extraction device 35 includes the extraction pin 23 which also serves as a locking pin 23 for circumferentially securing the vane 3 to the vane carrier 2. Accordingly, the locking pin 23 or extraction pin 23 is multifunctional and the extraction device 35 can be established in the vane arrangement 1 without any additional component apart from the extraction tool 39.

Alternatively, it is also possible to realize the extraction device 35 without the extraction pin 23 by providing the vane 3 directly with the extraction through-hole 36.

Figure 6:
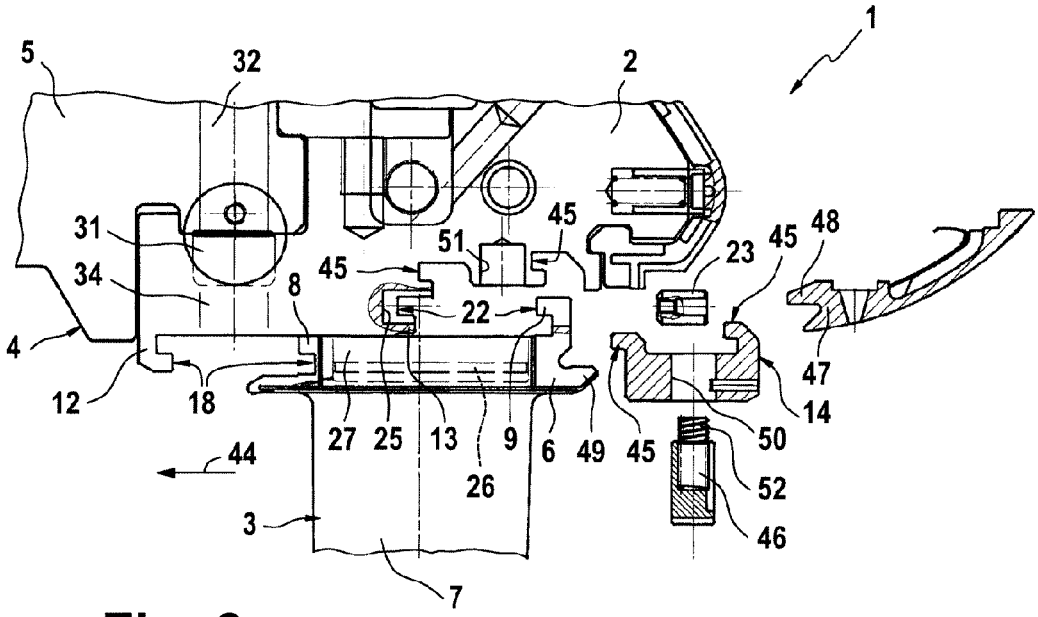
FIG. 6 depicts an exploded view of the vane arrangement according to FIG. 1.

According to FIG. 6 each single vane 3 can be mounted or dismounted independently from the other vanes 3. In particular, the vane carrier 2 does not need to be dismounted for mounting and dismounting of the vanes 3.

Before mounting the vane 3 at the vane carrier 2 the locking pin or extraction pin 23 is mounted by inserting it into the pin reception 25. Thereafter, the respective vane 3 is moved axially according to arrow 44. In an end phase of this axial movement, the two tongue-and-groove connections 18, 22 are established by axially plugging of the tongues 16, 20 into the respective grooves 17, 21. After that plugging action the respective vane 3 is radially attached to the vane carrier 2 by the form fit or positive fit provided by the tongue and groove connections 18, 22.

After mounting the vane 3, the securing element 14 is mounted to the vane carrier 2. Preferably the securing element 14 and the vane carrier 2 are provided with two tongue and groove connections 45, similar to the tongue and groove connections 18, 22, between the vane 3 and the vane carrier 2. The securing element 14 is attached to the vane carrier 2 by at least one locking bolt 46 in combination with at least one inlet segment 47. The inlet segment 47 is provided with an outer step 48. The platform 6 is provided with an inner step 49 arranged at the rear end of the platform 6 with respect to the mounting direction 44. The mounting direction 44 is oriented parallel to the flow direction. In the mounted condition according to FIG. 1 the outer step 48 of the inlet segment 47 engages the inner step 49 of the vane 3. Accordingly, the inlet segment 47 is supported by the vane 3. The inlet segment 47 may additionally be attached to the vane carrier 2 by additional fastening devices not shown.

The locking bolt 46 penetrates the securing element 14 within a through hole 50 and projects into a blind hole 51 provided at the vane carrier 2. In the mounted condition the locking bolt 46 is radially inwardly supported by the inlet segment 47. Radially outwardly, the locking bolt 46 is supported by the vane carrier 2 by a pressure spring 52. The locking bolt 46 secures the axial position of the securing element 14 and the support between the two steps 48 and 49.

LIST OF REFERENCES

1 vane arrangement
2 vane carrier
3 vane
4 turbo machine
5 housing
6 platform
7 airfoil
8 first locking portion
9 second locking portion
10 downstream side of 7
11 upstream side of 7
12 first carrier portion
13 second carrier portion
14 securing element
15 inner collar

16 inner tongue
17 inner groove
18 first tongue and groove connection
19 outer collar
20 outer tongue
21 outer groove
22 second tongue and groove connection
23 locking pin/extraction pin
24 recess
25 pin reception
26 deflector
27 hollow space
28 base
29 wall
30 cooling gas path
31 common collector channel
32 cooling gas supply channel
33 cooling gas flow
34 connecting hole
35 extraction device
36 extraction through-hole
37 inner thread
38 abutment zone
39 extraction tool
40 outer thread
41 drive portion
42 leading end
43 support contour
44 mounting direction
45 tongue and groove connection
46 locking bolt
47 inlet segment
48 outer step
49 inner step
50 through hole
51 blind hole
52 pressure spring
53 outer surface of 23
54 step of 23

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A turbo machine vane arrangement, comprising:

a turbo machine having a housing;

at least one vane carrier attached to the housing and defining axial and circumferential directions;

a plurality of vanes attached to the vane carrier and circumferentially arranged side by side;

wherein the vane carrier and vanes are mutually configured and arranged for the vanes to be axially pluggable into the carrier;

wherein at least one of the vanes comprises an extraction device comprising at least one axially extending extraction through-hole having an inner thread;

wherein the at least one vane carrier comprises an abutment zone axially opposing the extraction through-hole; and wherein the extraction device is configured and arranged to induce axially oriented extraction forces into the respective vane when an extraction tool is inserted into the extraction through-hole and axially pressing against the abutment zone.

2. The vane arrangement according to claim 1, wherein the extraction device is configured and arranged to induce an extraction force:

in the area of the attachment; or parallel to the plugging direction of the attachment; or coaxially to the plugging direction of the attachment; or combinations thereof.

3. The vane arrangement according to claim 1:

wherein the extraction through-hole and the inner thread are positioned at the respective vane; or further comprising an extraction pin comprising the extraction through-hole and the inner thread, the pin being a separate component from the respective vane and the at least one vane carrier).

4. The vane arrangement according to claim 3, wherein:

the extraction pin is torque proof fixed to the respective vane; or said at least one vane comprises an axially extending recess in which recess the extraction pin is positioned; or the extraction pin comprises two outer surfaces extending parallel to each other; or said at least one vane includes a support contour facing the abutment zone, and the extraction pin abuts the support contour; or said at least one vane includes a support contour facing the abutment zone, and the extraction pin comprises at least one step abutting the support contour; or the at least one vane carrier comprises a pin reception, and the extraction pin is positioned in the pin reception; or the at least one vane carrier comprises a pin reception, and the abutment zone is positioned at an axial end of the pin reception; or combinations thereof.

5. The vane arrangement according to claim 1, wherein:

each vane has a platform comprising a first locking portion and, axially displaced from the first locking portion, a second locking portion; or the at least one vane carrier comprises a first carrier portion and, axially displaced from the first carrier portion, a second carrier portion; or each vane has a platform comprising a first locking portion and, axially displaced from the first locking portion, a second locking portion, the at least one vane carrier comprises a first carrier portion and, axially displaced from the first carrier portion, a second carrier portion, and each locking portion and the respective carrier portion are mutually configured and arranged to form an axially pluggable and radially form locking attachment between the vane carrier and the respective vane; or the at least one vane carrier comprises at least one securing element configured and arranged to axially fix at least one of the vanes; or each vane has a platform comprising a first locking portion and, axially displaced from the first locking portion, a second locking portion, the at least one vane carrier comprises a first carrier portion and, axially displaced from the first carrier portion, a second carrier portion, and the carrier portions and the locking portions extend circumferentially; or each vane has a platform comprising a first locking portion and, axially and radially displaced from the first locking portion, a second locking portion; or each vane has a platform comprising a first locking portion and, axially and radially displaced from the first locking portion, a second locking portion, the at least one vane carrier comprises a first carrier portion and, axially displaced from the first carrier portion, a second carrier portion; or combinations thereof.

6. The vane arrangement according to claim 1, wherein:

the at least one vane carrier comprises a first carrier portion having an inner collar projecting radially inwards and extending circumferentially; or the at least one vane carrier comprises a first carrier portion having a radially inwardly projecting, circumferentially extending inner collar, the inner collar having an axially and circumferentially extending inner tongue; or each vane has a platform comprising a first locking portion having an axially open, circumferentially extending inner groove; or the at least one vane carrier comprises a first carrier portion having a radially inwardly projecting, circumferentially extending inner collar, the inner collar having an axially and circumferentially extending inner tongue, each vane has a platform comprising a first locking portion having an axially open, circumferentially extending inner groove, and the inner tongue and the inner groove are configured and arranged to provide a first tongue-and-groove connection between the vane carrier and the respective vane; or each vane has a platform comprising a first locking portion and, axially displaced from the first locking portion, a second locking portion, the second locking portion having a radially outwardly projecting, circumferentially extending outer collar; or the at least one vane carrier comprises a first carrier portion and, axially displaced from the first carrier portion, a second carrier portion, the second locking portion having a radially outwardly projecting, circumferentially extending outer collar, the outer collar having an axially and circumferentially extending outer tongue; or the at least one vane carrier comprises a first carrier portion and, axially displaced from the first carrier portion, a second carrier portion, the second carrier portion having an axially open, circumferentially extending outer groove; or the at least one vane carrier comprises a first carrier portion and, axially displaced from the first carrier portion, a second carrier portion, the second locking portion having a radially outwardly projecting, circumferentially extending outer collar, the outer collar having an axially and circumferentially extending outer tongue, the at least one vane carrier comprises a first carrier portion and, axially displaced from the first carrier portion, a second carrier portion, the second carrier portion having an axially open, circumferentially extending outer groove, the outer tongue and the outer groove configured and arranged to form a tongue-and-groove connection between the vane carrier and the respective vane; or combinations thereof.

7. The vane arrangement according to claim 6, further comprising:

an extraction pin comprising the extraction through-hole and the inner thread, the pin being a separate component from the respective vane and the at least one vane carrier;

wherein either the extraction through-hole or the extraction pin is arranged in or at the second locking portion or in or at the outer collar.

8. The vane arrangement according to claim 1, wherein:

each vane has a platform, and at least one of the vane platforms comprises a base and walls which radially outwardly project from the base, the base and walls defining a hollow space radially inwardly limited by the base and axially and circumferentially limited by the walls; or the at least one vane carrier comprises a common collector channel extending circumferentially; or the at least one vane carrier comprises a common collector channel extending circumferentially, and the housing comprises at least one cooling gas supply channel fluidly connected to the common collector channel; or the at least one vane carrier comprises a common collector channel extending circumferentially, and the at least one vane carrier comprises a plurality of connecting holes each fluidly connecting the common collector channel with one of the hollow spaces.

9. The vane arrangement according to claim 8, wherein:

each vane has a platform with a first locking portion, at least one of the vane platforms comprises a base and walls which radially outwardly project from the base, one of the walls comprising the first locking portion; or each vane has a platform comprising a first locking portion and, axially displaced from the first locking portion, a second locking portion, at least one of the vane platforms comprises a base and walls which radially outwardly project from the base, one of the walls comprising the first locking portion, and another wall comprises the second locking portion; or each vane comprises a platform with a base and an airfoil radially inwardly projecting from the base; or each vane has a platform, and at least one of the vane platforms comprises a base and walls which radially outwardly project from the base, the base and walls defining a hollow space radially inwardly limited by the base and axially and circumferentially limited by the walls, an airfoil radially inwardly projecting from the base, each airfoil containing a cooling gas path fluidly connected to the hollow space through the base.

10. The vane arrangement according to claim 1, further comprising:

an extraction tool having an outer thread matching the extraction through-hole inner thread and an end configured and arranged to push against the abutment zone, such that when the extraction tool is threaded through the extraction through-hole the end pushes against the abutment zone.

11. A turbo machine comprising:

at least one row of vanes provided with the vane arrangement according to claim 1.

12. A turbo machine according to claim 11, comprising a gas turbine including said at least one row of vanes.

* * * * *